US005381217A

United States Patent [19]

Ishida

[11] Patent Number: 5,381,217

[45] Date of Patent: Jan. 10, 1995

[54] DETACHABLY MOUNTED TONER UNIT HAVING A TONER SUPPLY UNIT AND A TONER RECOVERY HOUSING UNIT

[75] Inventor: Takao Ishida, Kanagawa, Japan

[73] Assignee: Kabushiki Kaisha Toshiba, Japan

[21] Appl. No.: 886,863

[22] Filed: May 22, 1992

[30] Foreign Application Priority Data

Jun. 21, 1991 [JP] Japan ..... 3-150578

[51] Int. Cl.[6] ..... G03G 15/06

[52] U.S. Cl. ..... 355/260; 355/215; 355/245; 355/298

[58] Field of Search ..... 355/245, 246, 260, 215, 355/296

[56] References Cited

U.S. PATENT DOCUMENTS

| | | | |
|---|---|---|---|
| 4,319,832 | 3/1982 | Sakamoto et al. | 355/215 |
| 4,412,736 | 11/1983 | Sakamoto et al. | 355/215 |
| 4,666,282 | 5/1987 | Rowe | 355/215 |
| 4,860,056 | 8/1989 | Kano et al. | 355/298 |
| 4,899,690 | 2/1990 | Hacknauer et al. | 355/260 x |
| 4,963,940 | 10/1990 | Nemoto et al. | 355/260 |
| 4,984,028 | 1/1991 | Tonomoto | 355/298 X |
| 5,066,983 | 11/1991 | Tonomoto | 355/298 X |
| 5,084,734 | 1/1992 | Yoshino et al. | 355/260 |
| 5,121,167 | 6/1992 | Gundlach | 355/298 X |
| 5,128,724 | 7/1992 | Hayashi et al. | 355/298 |
| 5,200,787 | 4/1993 | Nishiguchi | 355/298 |
| 5,204,720 | 4/1993 | Ishida et al. | 355/260 |
| 5,206,692 | 4/1993 | Ishida et al. | 355/260 |
| 5,223,068 | 6/1993 | Baley | 355/245 X |

*Primary Examiner*—A. T. Grimley
*Assistant Examiner*—Shuk Y. Lee
*Attorney, Agent, or Firm*—Banner, Birch, McKie & Beckett

[57] ABSTRACT

A toner unit includes a toner supply unit for storing the toner to be supplied to a developing device and a toner recovery housing unit integrated with the toner supply unit, for accommodating any recovered toner removed from an image bearing member by a cleaning device. The toner unit is detachably mounted on a processing unit having the developing device and the cleaning device. The toner recovery housing unit has an air flow portion for permitting air to flow inside of the toner recovery housing unit to outside so as to decrease the internal pressure of the toner recovery housing unit when the toner unit is mounted on the processing unit. Also, the toner supply unit has a toner replenishing portion for permitting replenishment of toner therein and the toner recovery housing unit has a recovered toner removing portion for permitting removal of recovered toner accommodated therein. Thereby, the toner unit may be repeatedly reused.

16 Claims, 7 Drawing Sheets

DETACHABLY MOUNTED TONER UNIT HAVING A TONER SUPPLY UNIT AND A TONER RECOVERY HOUSING UNIT

BACKGROUND OF THE INVENTION

1. Field of the Invention

This invention relates to an image forming apparatus, such as a laser printing apparatus, for forming an image on an image bearing member and, more particularly, to a detachably mounted toner unit including a toner supply unit for supplying toner to a developing device and a toner recovery housing unit for accommodating toner removed from an image bearing member by a cleaning device.

2. Description of the Related Art

Generally, in conventional image forming apparatus, a surface of an image bearing member, such as a photosensitive drum, is charged by a main charger of the apparatus. The entire surface of the drum is uniformly charged by the main charger. Then, a latent image is formed on the image bearing member. A developing device then develops the latent image using a developing agent (toner) to make the latent image visible. Subsequently, the developed image is transferred to a medium, such as a paper sheet, by an image transfer device. Most of the toner of the developed image on the image bearing member is transferred to the paper sheet by the image transfer device during the image transfer process. However, some portion of the toner of the developed image remains on the image bearing member after the transfer of the developed image to the paper sheet by the image transfer device. Thus, the residual toner particles on the image bearing member are typically removed from the image bearing member by a cleaning device of the apparatus.

In this conventional image forming apparatus, the toner is consumed during every image formation so that it is necessary to replenish the supply of toner for use by the developing device. Also, it is necessary to accommodate any recovered toner removed from the image bearing member by the cleaning device. Thus, the image forming apparatus has a toner supply unit for supplying the toner to the developing device and a toner recovery housing unit for housing the recovered toner removed from the image beating member by the cleaning device.

In recent image forming apparatus designs, several elements of the apparatus have been contained in one casing, so as to form a replaceable unit (herein referred to as a "processing unit"). For example, U.S. Pat. No. 3,985,436 discloses an image forming apparatus wherein the image bearing member, the developing device having the toner supply unit and the cleaning device having the toner recovery housing unit are contained in a single unit. This processing unit may be detached from the apparatus and replaced with a new processing unit upon expiration of its service life. Thus, all the devices contained within the single processing unit are exchanged simultaneously.

However, in this processing unit, the capacity for storing the developing toner and the recovered toner are limited because of the practical size of the processing unit. Therefore, the exchange cycle for this processing unit is short because of its capacity limitations, and the processing unit must be exchanged early and well before the expiration of the service life of the image bearing member. Thus, the operating cost for operating the known image forming apparatus is high.

In another embodiment, the toner supply unit and the toner recovery housing unit are separate from one another and are each adapted to be detachable. The toner supply unit may be detached from the developing device and the toner housing recovery unit can be detached from the cleaning device, and thus separately replaced as required. However, in this structure, a user must exchange either the toner supply unit or the toner recovery housing unit each time the toner supply is empty or the toner recovery housing unit is full. Thus, it is very troublesome for the user to have to exchange the toner supply unit or the toner recovery housing unit.

SUMMARY OF THE INVENTION

Accordingly, it is an object of the present invention to provide an image forming apparatus having a practical detachably mounted toner unit which includes a toner supply unit and a toner recovery housing unit.

It is an another object of the present invention to provide a detachably mounted toner unit having a toner supply unit and a toner recovery housing unit, which can be reused.

Accordingly, the foregoing objectives, as well as others, are achieved by the present invention, one embodiment of which comprises a toner unit adapted for detachable mounting on an image forming apparatus including a developing device for developing a latent image formed on an image bearing member with a toner and a cleaning device for removing the toner remaining on the image bearing member. The toner unit comprises a toner supply unit for storing the toner to be supplied to the developing device and a toner recovery housing unit integrated with the toner supply unit, for accommodating any recovered toner removed from the image bearing member by the cleaning device, The toner recovery housing unit includes an air flow portion for permitting air to flow from inside the toner recovery housing unit to the outside so as to release any internal pressure within the recovery toner housing unit as recovered toner collects when the toner unit is mounted on the apparatus and the apparatus is running.

A further embodiment of the present invention comprises a toner unit adapted for detachable mounting on an image forming apparatus including a developing device for developing a latent image formed on an image bearing member with a toner and a cleaning device for removing the toner remaining on the image bearing member. The toner unit comprises a toner supply unit for storing the toner to be supplied to the developing device and a toner recovery housing unit integrated with the toner supply unit, for accommodating any recovered toner removed from the image bearing member by the cleaning device. The toner supply unit has a toner replenishing portion for permitting replenishment of toner therein and the toner recovery housing unit has a recovered toner removing portion for permitting removal of recovered toner accommodated therein.

BRIEF DESCRIPTION OF THE DRAWINGS

A more complete appreciation of the present invention and many of the attendant advantages thereof will be readily obtained as the invention becomes better understood by reference to the following detailed description, when considered in connection with the accompanying drawings, wherein.

DETAILED DESCRIPTION OF THE PREFERRED EMBODIMENTS

Figure 1:
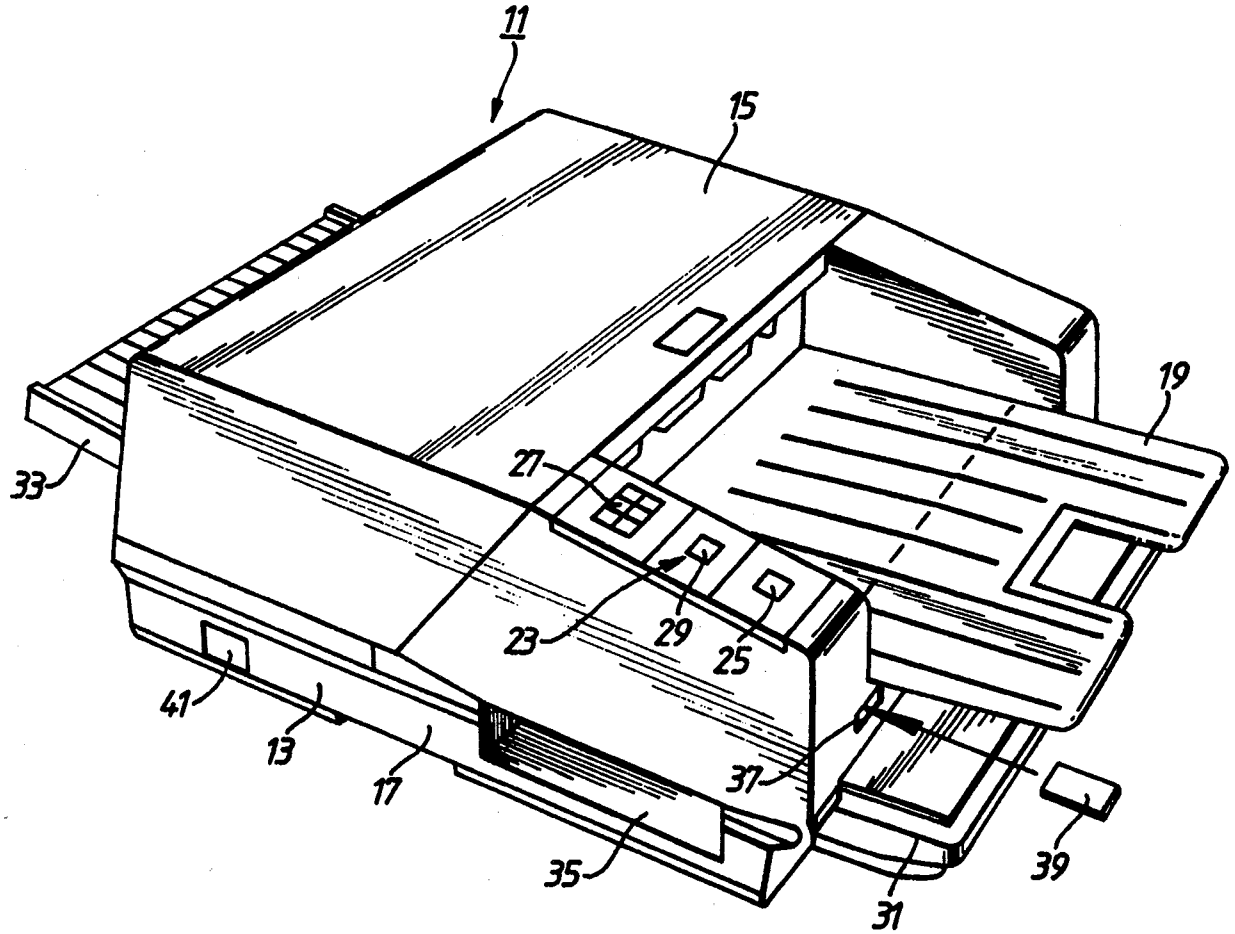
FIG. 1 is a perspective view of an image forming apparatus according to the present invention.

In the following detailed description, similar reference numerals will be used to denote similar elements in FIGS. 1–10. Referring first to FIG. 1 and to FIG. 2, an image forming apparatus, such as a laser printer 11, serves as an output device for a host computer (not shown). In response to a print command from the host computer, laser printer 11 forms an image on a recording medium, such as a paper sheet P (FIG. 3), according to data supplied from the host computer and feeds paper sheet P out to a user via a tray 19.

Figure 2:
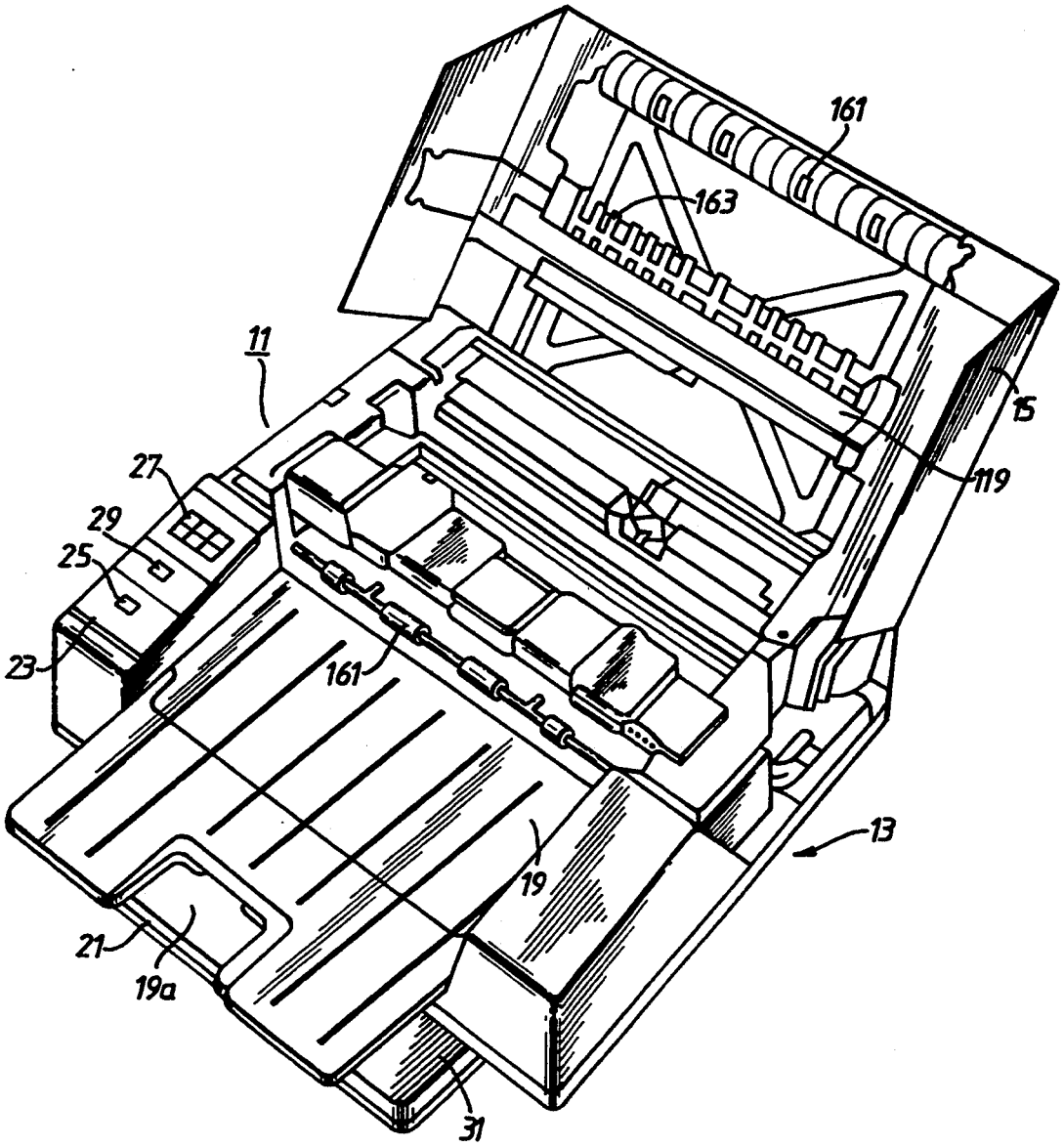
FIG. 2 is a second perspective view of the image forming apparatus according to the present invention, a top cover of the apparatus shown in FIG. 1 having been opened.

Laser printer 11 includes a housing 13 formed of an upper cover 15 and a lower frame 17. Upper cover 15 covers part of the upper portion of housing 13. Upper cover 15 is mounted by a hinge (not shown) to printer 11 and may be opened away from frame 17 as shown in FIG. 2. Output tray 19 is located on the other part of the upper portion of housing 13 than the portion protected by upper cover 15 and receives the printed paper sheet output from laser printer 11. Output tray 19 has a notch 19*a* located in the middle of the front end of output tray 19. A supplemental tray 21 (FIG. 2) is located at notch 19*a* and can be withdrawn or replaced into printer 11 as needed, for example, in order to accommodate various sizes, weights or colors of paper sheets P.

A control panel 23 is located on an upper front surface of housing 13 adjacent output tray 19. Control panel 23 includes a switch 25 for choosing an operating mode for printer 11 and a stratus indicator 27 for indicating the operating status of printer 11. Number indicator 29 indicates the number of sheets which have been printed or, alternatively, a print error code upon detection of a printing error.

Paper supply cassette 31 is inserted into lower frame 17 of housing 13, located under output tray 19. Hereinafter, the side of printer 11 into which cassette 31 is inserted will be referred to as the front side of laser printer 11. A manual feed tray 33 is inserted into the rear side of housing 13. Feed tray 33 is used as a guide for manually feeding individual paper at the rear of housing 13 (the left of printer 11 in FIG. 2). Housing 13 includes an input pert 27 for receiving a programming cartridge or an integrated circuit (IC) card 39 for automatically programming various print styles and fonts. A power switch 41 is located on the side surface of housing 13. An interface connector (not shown) may be plugged into I/O connector 35 in order to connect printer 11 to the host computer or such other devices which require printed images.

Figure 3:
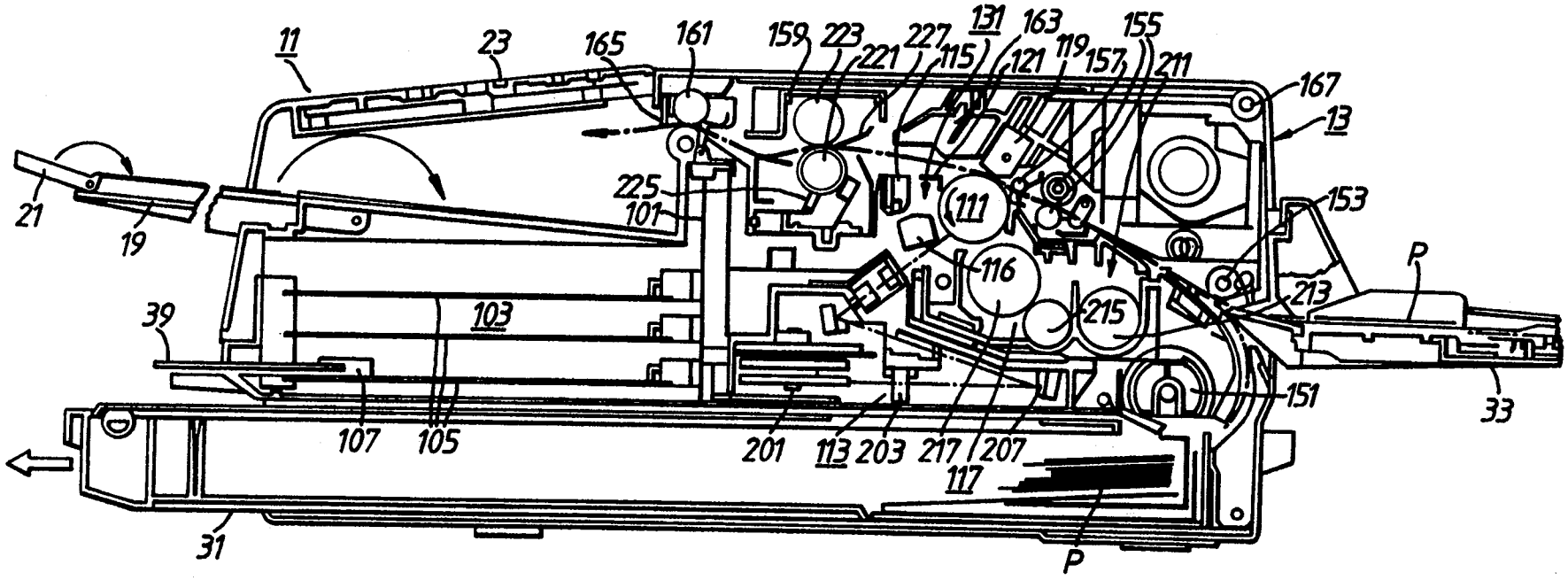
FIG. 3 is a sectional view of the image forming apparatus of the present invention shown in FIG. 1.

Referring now to FIG. 3, a sectional view of printer 11, the internal construction and operation of laser printer 11 will be described.

A main control board 101 is located near the center of housing 13. Control board 101 contains a controller or central processing unit (CPU) and related circuitry. An area 103 is located adjacent main control board 101. Area 103 provides space for a plurality of additional circuit boards, e.g., boards 105, to be mated to main control board 101. A connector 107 is located at the lowermost portion of area 103. Programming cartridge or integrated circuit (IC) card 39 may be plugged into connector 107 for programming special printer functions as already described.

Laser printer 11 includes an image bearing member, for example, a photosensitive drum 111, for forming a latent image in response to light. Photosensitive drum 111 is formed, for example, of an organic photoconductor (OPC) and is rotated in the indicated direction by an electric motor (not shown).

A laser unit 113 radiates a laser beam in response to data supplied from the host computer so that the latent image is formed on the surface of drum 111. Laser unit 113 includes a semiconductor laser (not shown) for generating a laser beam in response to data supplied from the host computer. A polygon mirror 201 reflects the laser beam so that the laser beam scans the surface of photosensitive drum 111 through first and second lenses 203 and 205 and first and second mirrors 207 and 209.

A developing unit 117 is located further around the periphery of the drum 111 in the indicated rotational direction of photosensitive drum 111. Developing unit 117 develops the latent image on drum 111 with a toner in order to form a toner image. Developing unit 117 includes a container 211 which contains a two-element developer having a toner and a toner carrier. Container 211 includes first and second stirrers 213 and 215 for mixing the toner and the toner carrier together. Developing unit 117 also has a developing roller 217 for transporting the mixture of toner and toner carrier to a developing position or station facing the surface of photosensitive drum 111.

An image transfer unit 119 is located further around the drum 111 from the developing unit 117 in the indicated rotational direction of photosensitive drum 111. Image transfer unit 119 transfers the toner image onto paper sheet P supplied from cassette 31.

A discharging unit 115 and a charging unit 116 are located just prior to laser unit 113 in the opposite rotational direction than the direction indicated on photosensitive drum 111. Discharging unit 115 includes a lamp (not shown) for radiating the surface of photosensitive drum 111 in order to set the electrical potential of the surface of photosensitive drum 111 to a uniform level. After the electrical potential of the surface of photosensitive drum 111 is set, charging unit 116 charges the entire surface of drum 111 in order to prepare the surface for forming the latent image.

A cleaning unit 121, forming a drum cleaning station, is located further around drum 111 from image transfer unit 119 in the indicated rotational direction on photosensitive drum 111. Cleaning unit 121 has an elastic blade which contacts the surface of photosensitive drum 111 so as to scrape residual toner from the surface of photosensitive drum 111.

Figure 4:
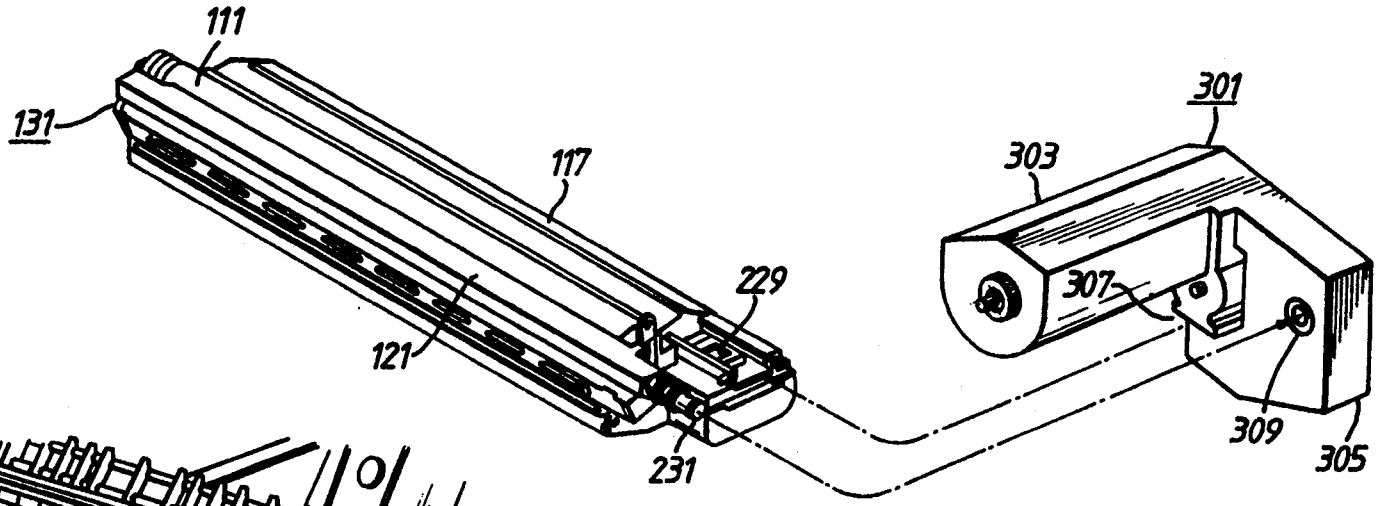
FIG. 4 is a perspective view showing the mounting of an embodiment of a detachably mounted toner unit according to the present invention for the image forming apparatus of FIG. 1.

Photosensitive drum 111, developing unit 117, discharging unit 115, charging unit 116 and cleaning unit 121 are contained in a processing unit 131 as a single body, as shown in FIG. 4. Processing unit 131 is detachably mounted into laser printer 11.

Referring again to FIG. 3, along with the process of forming a latent image on drum 111, paper sheet P is transported from cassette 31 or from manual feeding tray 33 when cassette 31 is inserted into housing 113 of printer 11, as shown at the right side of housing 13. Pickup roller 151 has a cross-sectional shape of a half-moon, i.e., roller 151 has a flat surface. When the flat surface of pickup roller 151 faces cassette 31, pickup roller 151 is out of contact with paper sheet P. However, when the curved surface of pickup roller 151 faces cassette 31, pickup roller 151 is in contact with paper sheet P which allows pickup roller 151 to pick up paper sheet P during its rotation.

Paper sheet P, when picked up by pickup roller 151 from cassette 31, is transported to a position (hereinafter referred to as the image transfer position) at which image transfer unit 119 faces photosensitive drum 111 through a pair of conveying rollers 153, a pair of aligning rollers 155 and a pair of conveying rollers 157.

Paper sheet P is transported from cassette 31 or manual feeding tray 33 to output tray 19. A fixing unit 159 or image fixing position is located toward the printed paper output in relation to the image transfer position. Fixing unit 159 fixes the toner image onto paper sheet P by heating and pressing paper sheet P with the toner image. Fixing unit 159 includes a heat roller 221 and a pressure roller 223 in contact with heat roller 221. A cleaner 225 is in contact with the surface of heat roller 221 in order to keep the surface of heat roller 22 1 clean. Paper sheet P with the transferred toner image is conveyed between heat roller 221 and pressure roller 223, guided by a paper guide 225.

A pair of eject rollers 161 are located further along the printed paper output path beyond fixing unit 159. Eject rollers 161 eject paper sheet P with the fixed toner image onto output receiving tray 33.

Guide 163 is located between the image transfer position and fixing unit 159. Guide 163 is made of metal and is electrically grounded to printer 11. During the image forming operation, guide 163 faces a side surface (hereinafter referred to as a non-image surface) of paper sheet P, on which there is no toner image. Thus, guide 163 electrostatically attracts paper sheet P toward guide 163 without disturbing the toner image on the opposite surface of paper sheet P.

A discharging brush 165 is located next to but further along the printed paper output path than eject rollers 161. Discharging brush 165 is brought into contact with the non-image surface of paper sheet P immediately after eject rollers 161 ejects paper sheet P toward output tray 19 with the toner image. Discharging brush 165 discharges static electric charge built-up on paper sheet P. Upper cover 15 is pivotally mounted to lower frame 17 through an axis 167 located on an upper portion of the rear side of housing 13. Upper cover 15 can be opened away from lower frame 17 as shown in FIG. 2. Upper cover 15 includes image transfer unit 119, guide 163, an upper roller of the pair of eject rollers 161 and discharging brush 165 (not shown in FIG. 2).

Figure 5:
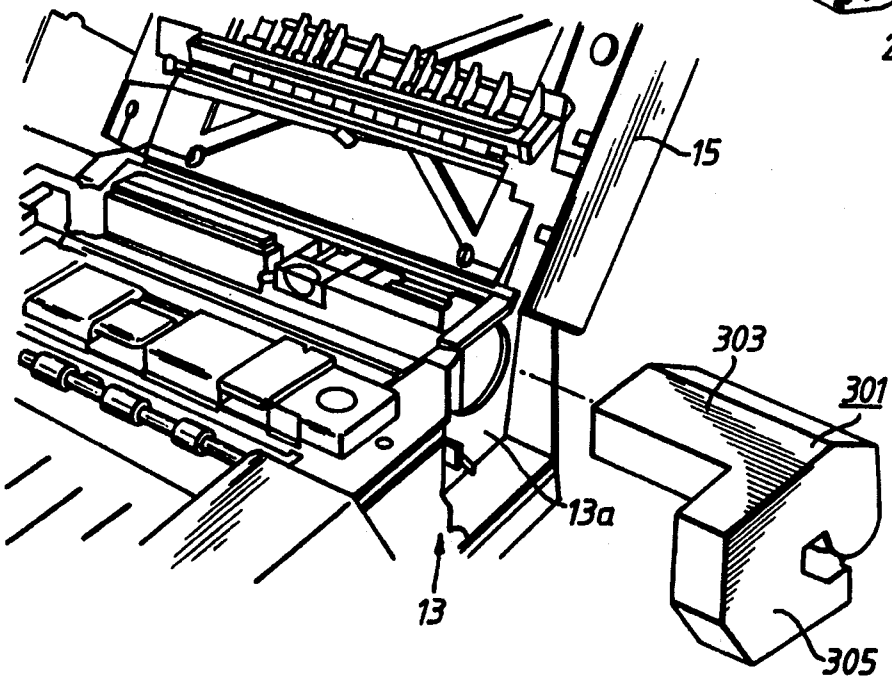
FIG. 5 is a partial perspective view of the image forming apparatus of FIG. 1, the top cover having been opened as shown in FIG. 2 to reveal the detachably mounted toner unit of FIG. 4.

As showing in FIG. 4, laser printer 11 of the present invention also includes a toner unit 301 adapted to be detachably mounted on processing unit 131 which itself is adapted to be detachably mounted to printer 11 (FIGS. 1 or 2). Toner unit 301 includes a toner supply unit 303 and a toner recovery housing unit 305 integrated with toner supply unit 303. Toner supply unit 303 stores the toner to be supplied to developing unit 117 of processing unit 131. Toner recovery housing unit 305 accommodates the recovered toner removed from photosensitive drum 111 by cleaning unit 121. Referring briefly to FIG. 5, toner unit 301 is removably inserted from the side of a right frame portion **13*a* of housing 13 when toner unit 301 is mounted on processing unit 131. Referring again to FIG. 4, processing unit 131 has a toner receiving portion 229, which is located on the upper part thereof, for receiving toner from toner supply unit 303. Toner supply unit 303 has an engage portion 307 such that engage portion 307 is slidably engaged with toner receiving portion 229 when toner unit 301 is mounted on processing unit 131. Also, processing unit 131 includes a recovered toner supplying portion 231, which is located on the side portion thereof, for supplying the recovered toner from cleaning unit 121 to toner recovery housing unit 305. Toner recovery housing unit 305 has a recovered toner receiving portion 309 which fits in recovered toner supplying portion 231 when toner unit 301 is mounted on processing unit 131**.

Referring now to FIGS. 6 to 9, comprising various sectional views of the processing unit 131 or the toner unit 301, the internal construction of toner unit 301 will be described.

Figure 6:
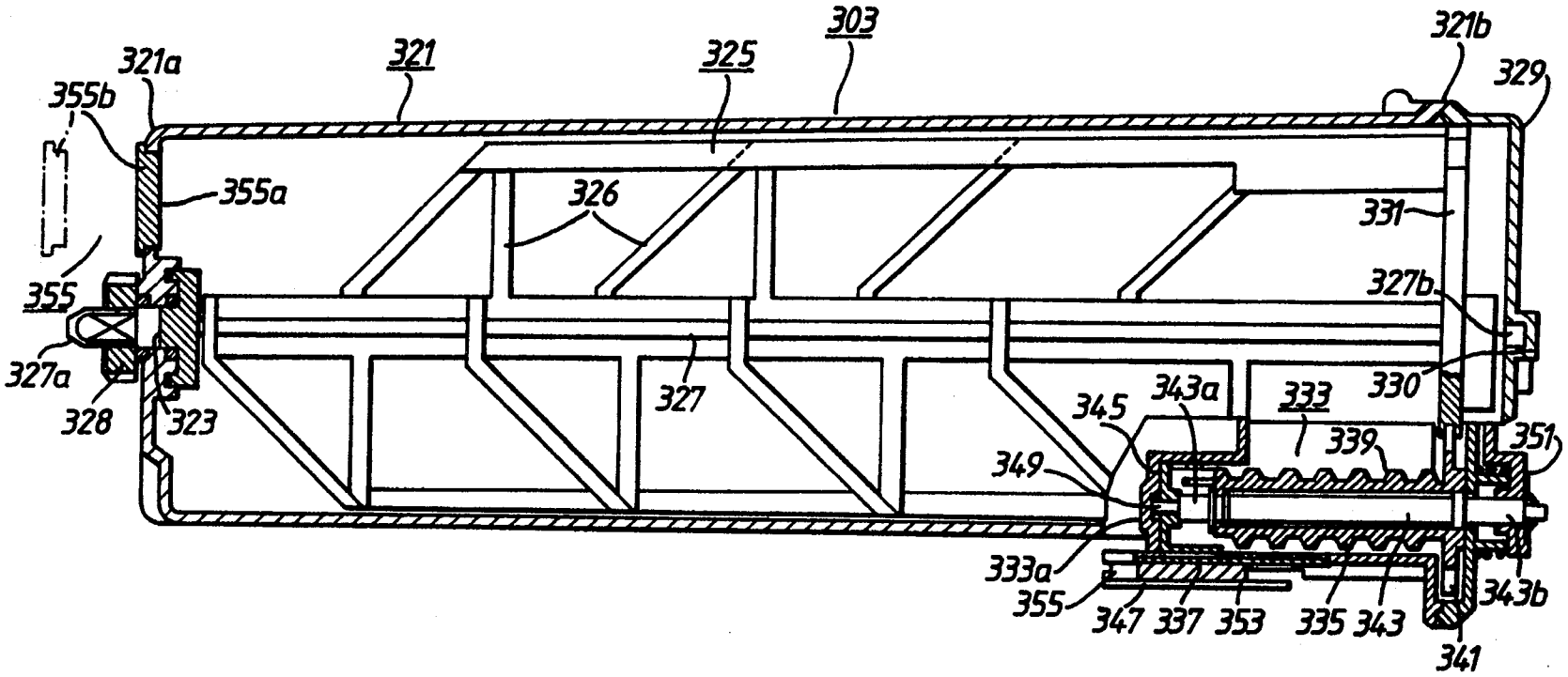
FIG. 6 is a sectional view of a toner supply unit portion of the toner unit shown in FIG. 4.

FIG. 6 shows the internal construction of toner supply unit 303. Toner supply unit 303 includes a hopper-type elongated container 321 for storing the toner to be supplied to developing unit 117. Container 321 is formed of a synthetic resin, such as ABS resin. Container 321 is tapered, slightly widened from a left end face portion **321*a* towards a fight end face portion 321*b*. Left end face potion 321*a* of container 321 along the longitudinal axis is closed and fitted in housing 13**.

Toner supply unit 303 includes a toner stirring portion 325, provided in container 321, for stirring the stored toner. Toner stirring portion 325 includes a plurality of puddle frames 326 in the form of reel-shaped ABS resin frames. Puddle frames 326 are helically integrated with a rotary shaft 327. In toner stirring portion 325, the toner stored in container 321 is stirred by puddle frames 326 and is conveyed from the left side of container 321 to the right side of container 321.

Left end surface portion **321*a* of container 321 has a shaft hole 323. A drive-side end portion 327*a* of rotary shaft 327 is inserted into shaft hole 323. Drive-side end portion 327*a* is coupled to a drive gear 328 engaged with a drive gear (not shown) of laser printer 11. Right end face portion 321*b* of container 321 is tightly sealed by a cover 329. A bearing portion 330 is provided on an inner surface of cover 329. Beating portion 330 supports an end portion 327*b* of rotary shaft 327 which is integrated with a large-diameter gear 331**.

Toner supply unit 303 also includes a toner supply portion 333 formed on the right side of the bottom of container 321. Toner supply portion 333 receives the toner stirred and conveyed by toner stirring portion 325, and then the received toner may be supplied to developing unit 117 through toner supply portion 333. Toner supply portion 333 includes a toner conveying portion 335 for conveying the toner and a toner supply port 337 formed in the left part of the bottom thereof. Toner conveying portion 335 includes a spiral hollow shaft 339 integrated with a small-diameter gear 341. A support shaft 343 is loosely inserted into spiral hollow shaft 339 so as to allow rotation of shaft 339. Small-diameter gear 341 is engaged with large-diameter gear 331. Thereby, spiral shaft 339 is rotated by the rotation of large-diameter gear 331, and the toner supplied into toner supply portion 333 is conveyed to toner supply port 337.

Toner supply portion 333 also includes a first shutter 345 and a second shutter 347. First shutter 345 opens a left-side bottom portion of toner supply portion 333. First shutter 345 includes a rotary shutter 349 and an operating level 351 for moving rotary shutter 349 to the position corresponding to toner supply port 337. Rotary shutter 349 is rotatably attached to a first end portion 343*a* of support shaft 343 and rotates synchronously with shaft 343. Operating lever 351 is fixed to a second end portion 343*b* of support shaft 343. When toner unit 301 is mounted on processing unit 131 and upper cover 15 is closed, operating lever 351 comes into contact with an operating projection (not shown) formed on the inner face of upper cover 15, and then operating lever 351 is rotated. Thereby, rotary shutter 349 is moved by operating lever 351 and toner supply port 337 is opened. Also, when toner unit 301 is not mounted on processing unit 131, or when toner unit 301 is not mounted on processing unit 131 and upper cover 15 is opened away from lower frame 17, operating lever 351 is not in contact with the operating projection. Thereby, toner supplying port 337 is closed by rotary shutter 349.

Second shutter 347 is provided below toner supply port 337 of toner supply portion 333. Second shutter 347 includes a slide shutter 353 and a compression spring 355. Slide shutter 353 may slidably move to toner supply port 337. Thereby, toner supply port 337 is opened and closed by slide shutter 353. Compression spring 355 urges slide shutter 353 in one direction so as to prevent slide shutter 353 from being brought to the position corresponding to toner supply port 337. Second shutter 347 is operated only when toner unit 301 is mounted on processing unit 131.

Also, toner supply unit 303 includes a toner replenishing portion 355, which is provided on left end face portion 321*a* of container 321, for replenishing new toner into container 321. Toner replenishing portion 355 has a toner replenishing port 355*a* and a cap 355*b* removably mounted on toner replenishing port 355*a*. Cap 355*b* is formed of rubber or the like and closes toner replenishing port 355*a* after the new toner has been replenished. Thereby the user can replenish the new toner from toner replenishing portion 355 when toner supply unit 303 is emptied.

Figure 7:
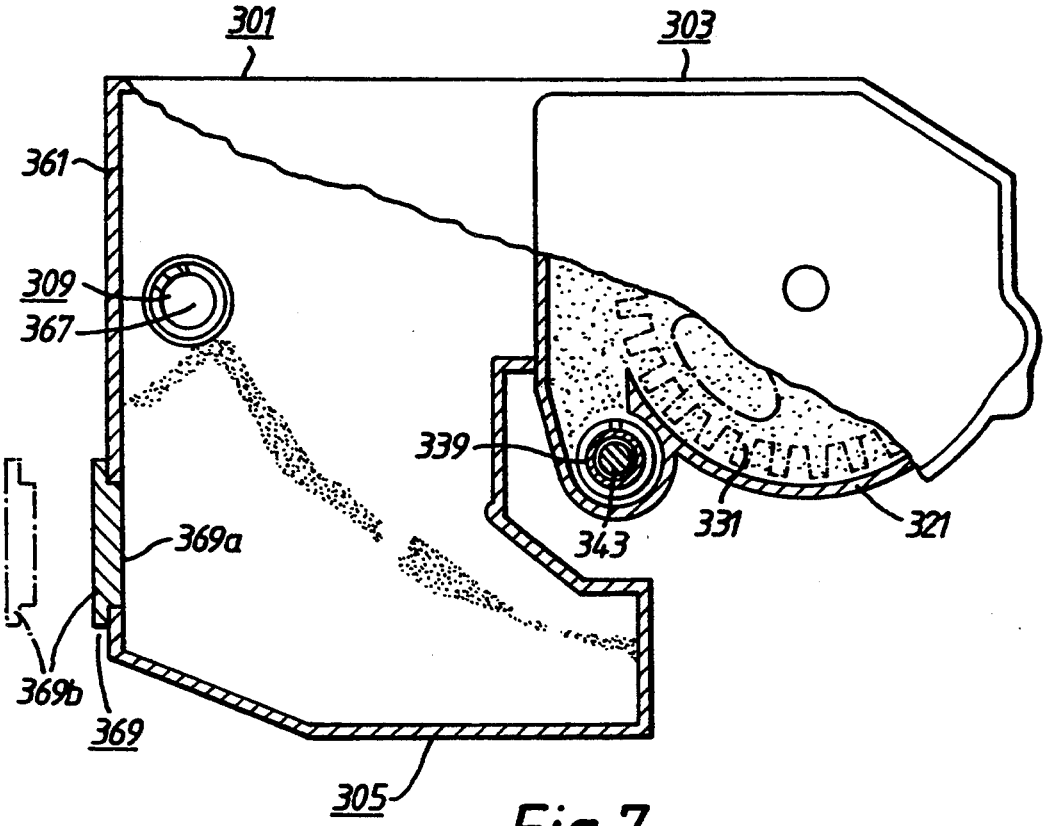
FIG. 7 is a sectional view of a toner recovery housing unit portion of the toner unit shown in FIG. 4.
Figure 8:
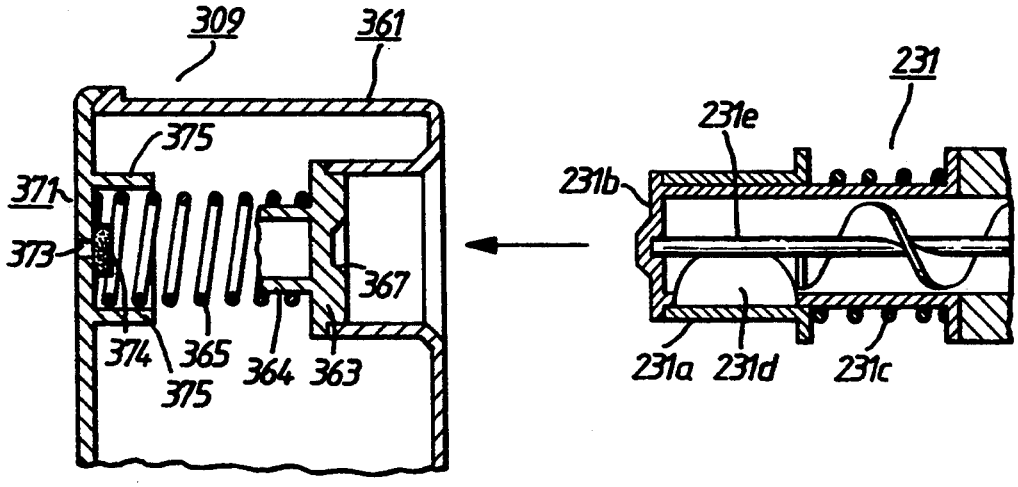
FIGS. 8 and 9 are sectional views of a recovered toner supply portion of a detachably mounted processing unit of the image forming apparatus of FIG. 1 and of a recovered toner receiving portion of the toner recovery housing unit portion of the toner unit shown in FIG. 4.
Figure 9:
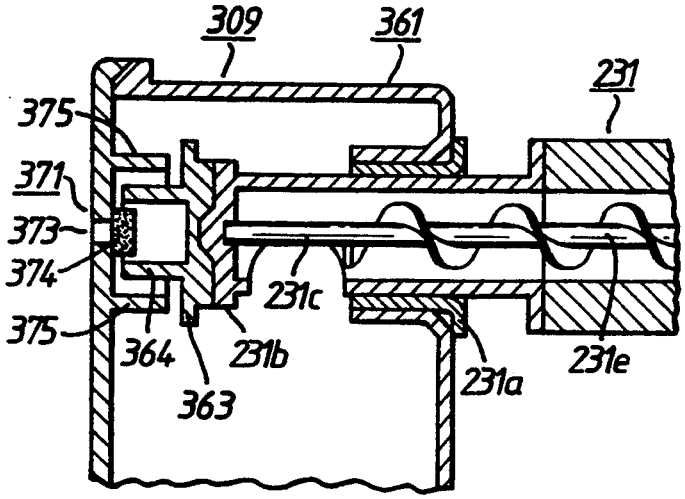

FIGS. 7 to 9 are sectional views showing the construction of toner recovery housing unit 305.

Toner recovery housing unit 305 includes a box-shaped container 361 for accommodating the recovered toner received from processing unit 131 as shown in FIG. 7. Container 361 is integrated with container 321 of toner supply unit 303. Container 361 is formed of a synthetic resin, such as ABS Resin. Toner supply unit 303 and toner recovery housing unit 305 are completely partitioned, such that the toner stored in container 321 and the recovered toner stored in container 361 can not mix with each other.

As described above, toner recovery housing unit 305 also includes recovered toner receiving portion 309 for receiving the recovered toner supplied from cleaning unit 121 of processing unit 131. Recovered toner supplying portion 231 of processing unit 131 (shown in FIG. 4) is inserted into recovered toner receiving portion 309. Thus, recovered toner supplying portion 231 is wholly inserted in recovered toner receiving portion 309, such that the recovered toner removed from photosensitive drum 111 by cleaning unit 121 may be accommodated in toner recovery housing unit 305.

Recovered toner receiving portion 309 has a recovered toner receiving hole 367 laterally located on a side face of container 361. Thus, the recovered toner can be easily accommodated in toner recovery housing unit 305 unless recovered toner receiving portion 309 is completely covered with recovered toner. If recovered toner receiving hole 367 faces downwards, the recovered toner can easily fall in the initial stages of toner recovery. However, the top of stored recovered toner will finally close recovered toner receiving hole 367. Thus, it is very difficult to further accommodate any additional recovered toner in toner recovery housing unit 305.

Referring now to FIGS. 8 and 9, the structures of recovered toner supply portion 231 of processing unit 131 and recovered toner receiving portion 309 of toner recovery housing unit 305 will be described.

Recovered toner receiving portion 309 includes a cap 363, a compression spring 365 and a recovered toner receiving hole 367. Cap 363 is urged outward by a compression spring 365 to close recovered toner receiving hole 367. Recovered toner supply portion 231 once inserted into recovered toner receiving portion 367 actuates a slide shutter 231*a* attached to an end portion thereof. Slide shutter 231*a* is urged towards the end of a nozzle 231*b* by a compression spring 231*c*. Thereby, opening 231*c* of recovered toner supply portion 231 is closed.

When toner unit 301 is mounted on processing unit 131, recovered toner supply portion 231 is inserted into recovered toner receiving portion 309, as shown in FIG. 9. Slide shutter 231*a* is inserted in recovered toner receiving portion 309 and its flange portion is pressed to container 361 by compression spring 231*c*. Slide shutter 231*a* closes the gap between container 361 and nozzle 231*b*, such that recovered toner in container 361 may not leak. An opening 231*d* of nozzle 231*b* is completely opened in container 361. Thereby, the recovered toner conveyed by a convey spiral 231*e* of recovered toner supply portion 231 can be supplied to toner recovery housing unit 305 smoothly. When toner unit 301 is removed from processing unit 131, opening 231*d* of recovered toner supply portion 231 is closed by slide shutter 231*a*. Also, recovered toner receiving hole 367 of recovered toner receiving portion 305 is closed by cap 363. Thus, the recovered toner may not leak from processing unit 131 and toner recovery housing unit 305.

In the present embodiment, when upper cover 17 is opened, convey spiral 231*e* of recovered toner supply portion 231 is rotated by a motor (not shown). Thereby, all toner recovered in cleaning unit 121 is stored in toner recovery housing unit 305 after toner unit 131 is removed from processing unit 131.

Recovered toner receiving portion 309 also includes an air flow portion 371 for permitting air to flow from inside of container 361 to outside so as to release any internal pressure of container 361 as the container fills when toner unit 301 is mounted on processing unit 131. Air flow portion 371 has an air hole 373 formed on a center portion of the attaching position of compression spring 365, a filter 374 for plugging air hole 373 and a side wall 375 formed on the circumference of air hole 373. Air hole 373 permits air to flow from the inside to the outside. Filter 374 is formed a cloth or the like, such that the air can pass through filter 374; however, the recovered toner cannot pass through filter 374. Side wall 375 determines the position of compression spring 375. Also, side wall 375 and a side wall 364 of cap 363 can prevent the recovered toner stored in toner recovery housing unit 305 from collecting in the vicinity of air flow portion 371.

When recovered toner supply portion 231 of processing unit 131 is inserted in recovered toner receiving portion 309 of toner recovery housing unit 305 as shown in FIG. 9, the internal pressure of container 361 of toner recovery housing unit 305 increases. Thus, the recovered toner stored in toner recovery housing unit 305 may even explode from recovered toner supply portion 231 and recovered toner receiving portion 309, such that the recovered toner is scattered on processing unit 131 and inside housing 13. To the contrary, in the present embodiment, when recovered toner supply portion 231 is inserted in recovered toner receiving portion 309, the air can flow from the inside of container 361 to the outside through air flow portion 371 of recovery toner housing unit 305. Thereby, the internal pressure of container 361 does not increase. In fact, the internal pressure is released as recovered toner collects. Thus, the recovered toner will not explode from toner recovery housing unit 305. The recovered toner can not pass through filter 374, and the recovered toner may not leak from air flow portion 371. Therefore, the recovered toner accommodated in toner recovery housing unit 305 is not scattered on processing unit 131 and inside housing 13 when toner unit 301 is mounted on processing unit 131. Referring again to FIG. 7, toner recovery housing unit 305 includes a recovered toner removing portion 369, which is provided on a left end face 361 *a* of container 361, for removing the recovered toner stored in recovered toner receiving portion 309. Recovered toner removing portion 369 has a recovered toner removing port 369*a* and a cap 369*b* detachably attached to recovered toner removing port 369*a*. Cap 369*b* is formed of rubber or the like and closes recovered toner removing port 369*a*. Thereby, the user can remove the recovery toner stored in toner recovery housing unit 305 from recovered toner removing portion 369 when toner recovery housing unit 305 is full.

As described above, in the present embodiment, toner unit 301 includes toner supply unit 303 having toner replenishing portion 355 and toner recovery housing unit 305 having recovered toner removing portion 369. Thus, toner unit 301 can be reused when toner supply unit 303 has emptied and toner recovery housing unit 305 is full. For example, when toner supply unit 303 is empty, the user can replenish new toner into toner supply unit 303 from toner replenishing portion 355. Also, when toner recovery housing unit 305 is full, the user can remove the recovered toner accommodated in toner recovery housing unit 305 from recovered toner removing portion 369. Thus, toner unit 301 can be reused repeatedly. It is not necessary to replace the toner unit with a new unit mounted to processing unit 131 when toner supply unit 303 is empty or recovered toner receiving unit 305 is full.

Figure 10:
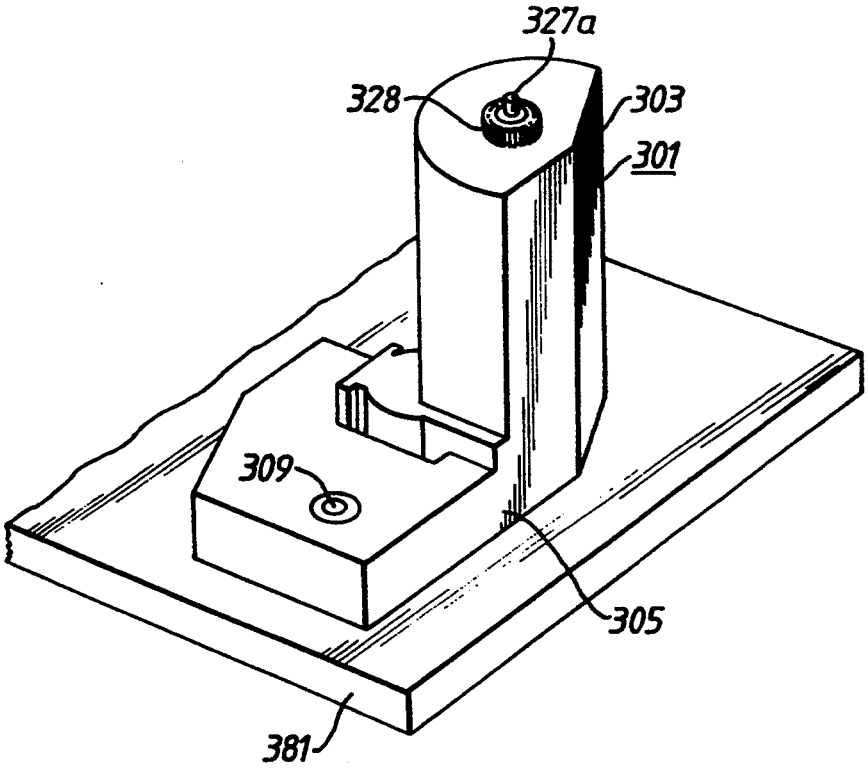
FIG. 10 is a side view of the toner unit according to the present invention laid on a planar surface.

Also, in the present embodiment, when toner unit 301 is set on a planar surface such as a desk or on a floor, the user should hesitate to set toner unit 301 with recovery toner receiving portion 309 down because of the structure of toner supplying unit 303 having drive-side end portion 327*a* and drive gear 328 formed of left end face portion 321*a*. Thus, the user will usually place toner unit 301 on the desk 381 with recovery toner receiving portion 309 up or set on its side, for example, with right end face portion 321*b* down, as shown in FIG. 10. This is of particular importance when toner recovery housing unit 305 contains therein the recovered toner. If toner unit 301 is set on a planar surface or desk 381 with recovered toner receiving portion 309 down, the recovered toner would flow from recovered toner receiving portion 309 on to desk 381. Thus, desk 381 would be soiled by the recovered toner. Toner unit 301, in accordance with the present invention, therefore, serves to prevent such problems relating to filling the toner supply or disposing of recovered toner. By the shape of the toner unit of the present invention, the user is encouraged to properly fill new toner or dispose of recovered toner.

As described above, in the present embodiment, toner unit 301 includes toner supply unit 303 and toner recovery housing unit 305 integrated with toner supply unit 303. Thus, toner supply unit 303 and toner recovery housing unit 305 can be exchanged by a single process and the operability of printer 11 can be enhanced. Toner unit 301 is detachably mounted to processing unit 131 which contains developing unit 117 and cleaning unit 121. Therefore, it is not necessary to exchange processing unit 131 when toner unit 301 is exchanged. Toner supply port 337 of toner supply unit 303 and recovered toner receiving hole 367 of toner recovery housing unit 305 are closed whenever toner unit 301 is not mounted on processing unit 131. Thereby, the toner stored in toner unit 301 can not leak from toner unit 301. Also, the toner can be supplied to processing unit 131 and the recovered toner can be conveyed from processing unit 131 by inserting toner unit 301 into the side of fight frame portion 13*a* of housing 13 (see FIG. 5) and mounting on processing unit 131.

Toner unit 301 also includes toner supply unit 303 having toner replenishing portion 355 and toner recovery housing unit 305 having recovered toner removing portion 369. Thus, toner unit 301 can be reused repeatedly.

Toner recovery housing unit 305 includes air flow portion 371 for permitting air to flow from the inside of container 361 to the outside so as to decrease the internal pressure of container 361 when toner unit 301 is mounted on processing unit 131. Thus, the recovered toner may not explode from toner recovery housing unit 305 and processing unit 131 and the inside of housing 13 are not soiled by the toner.

In the embodiments described above, a processing unit includes a photosensitive drum, a developing unit and a cleaning unit. Alternatively, however, the processing unit may be provided with, for example, a first unit comprising the photosensitive drum and the developing unit, and a second unit comprising the cleaning unit. In this case, portions of the toner unit according to the present invention can be detachably mounted on the first unit and the second unit. In particular, a toner supply unit of the toner unit may be detachably mounted on the first unit and a toner recovery housing unit of the toner unit may be detachably mounted on the second unit. In a case where the photosensitive drum, the developing unit and the cleaning unit are respectively separate, the toner supply unit maybe detachably mounted on the developing unit and the toner recovery housing unit may be detachably mounted on the cleaning unit. The kind of apparatus to which the toner unit according to the present invention is applicable is not limited to laser printer but may be applicable to any electronic printer known in the art, for example, which may use a powdered, liquid or other toner. Furthermore, the present invention is applicable to other types of image forming apparatus such as copying machines and facsimile apparatus.

It should be understood that the detailed description and exemplary embodiments, which indicate presently preferred embodiments of this invention, are given by way of illustration only. Various modifications and changes may be made to the present invention, without departing from the scope or spirit of the invention, as set forth in the following claims.

I claim:

1. A toner unit adapted to be detachably mounted on an image forming apparatus including a developing device for developing a latent image formed on an image bearing member with a toner and a cleaning device for removing the toner remaining on the image bearing member, the toner unit characterized by:

a toner supply unit for storing toner to be supplied to the developing device and a toner recovery housing unit, integrated with the toner supply unit, for accommodating recovered toner removed from the image bearing member by the cleaning device, the toner recovery housing unit having an air flow portion for permitting air to flow from inside of the toner recovery housing unit to outside to decrease internal pressure of the toner recovery housing unit as recovered toner collects when the toner unit is mounted on the image forming apparatus.

2. An image forming apparatus for forming an image on an image bearing member, the apparatus comprising:

developing means for developing a latent image formed on the image bearing member with a toner;

cleaning means for removing toner remaining on the image bearing member; and a toner unit adapted to be detachably mounted on the image forming apparatus, the toner unit comprising a toner supply unit for storing the toner to be supplied to the developing means and a toner recovery housing unit integrated with the toner supply unit, for accommodating recovered toner removed from the image bearing member by the cleaning means, the toner recovery housing unit having an air flow portion for permitting air to flow from inside the toner recovery housing unit to outside to decrease internal pressure of the toner recovery housing unit as recovered toner collects when the toner unit is mounted on the image forming apparatus.

3. An image forming apparatus according to claim 2, the air flow portion of the toner unit comprising a filter for preventing the recovered toner accommodated in the toner recovery housing unit from passing outside the toner recovery housing unit.

4. An image forming apparatus according to claim 2, the toner supply unit of the toner unit comprising a toner supply portion engaged with the developing means to supply the toner to the developing means when the toner unit is mounted on the image forming apparatus; and the toner recovery housing unit of the toner unit comprising a recovered toner receiving portion engaged with the cleaning means to receive the recovered toner from the cleaning means when the toner unit is mounted on the image forming apparatus.

5. An image forming apparatus according to claim 2, the air flow portion comprising preventing means for preventing the recovered toner accommodated in the toner recovery housing unit from collecting near of the air flow portion thereof.

6. A method for accommodating recovered toner removed from an image bearing member of an image forming apparatus by a cleaning device of the apparatus into a toner unit adapted to be detachably mounted on the image forming apparatus, the toner unit having a toner supply unit for storing toner to be supplied to a developing device of the apparatus and a toner recovery housing unit, integrated with the toner supply unit, for accommodating the recovered toner removed from the image bearing member by the cleaning device, the method comprising the step of:

supplying the recovered toner from the cleaning device to the toner recovery housing unit of the toner unit when the toner unit is mounted on the image forming apparatus, and characterized by the step of:

permitting air to flow from inside the toner recovery housing unit to outside to release internal pressure of the toner recovery housing unit as recovered toner collects when the toner unit is mounted on the image forming apparatus.

7. A method according to claim 6 further characterized by the step of preventing recovered toner accommodated in the toner recovery housing unit from passing outside the toner recovery housing unit.

8. A toner unit adapted to be detachably mounted on an image forming apparatus which includes a developing device for developing a latent image formed on an image bearing member with a toner and a cleaning device for removing the toner remaining on the image bearing member, said toner unit comprising:

a toner supply unit for storing the toner to be supplied to the developing device;

a toner recovery housing unit for accommodating recovered toner removed from the image bearing member by the cleaning device, the toner recovery housing unit having an air flow portion for permitting air to flow from inside of the toner recovery housing unit to outside so as to decrease a change of internal pressure of the toner recovery housing unit when the toner unit is mounted on the image forming apparatus, said air flow portion having preventing means for preventing the removed toner accommodated in the toner recovery housing unit from collecting the air flow portion.

9. A toner unit according to claim 8, wherein the preventing means includes a side wall formed on a circumference of the air flow portion.

10. A toner unit according to claim 8, wherein the air flow portion includes a filter for preventing the recovered toner accommodated in the toner unit from passing outside of the toner unit.

11. An image forming apparatus for forming an image on an image bearing member, said image forming apparatus comprising:

a processing unit adapted to be detachably mounted on said image forming apparatus, said processing unit further comprising said image bearing member, a developing device for developing a latent image formed on the image bearing member with a toner and a cleaning device for removing toner remaining on the image bearing member; and a toner unit adapted to be detachably mounted on the processing unit, said toner unit including a toner supply unit for storing the toner to be supplied to said developing device and a toner recovery housing unit for accommodating recovered toner removed from the image bearing member by said cleaning device, said toner recovery housing unit having an air flow portion for permitting air to flow from inside of said toner recovery housing unit to outside of said toner recovery housing unit to decrease a change of internal pressure in said toner recovery housing unit when said toner unit is mounted on the processing unit, said air flow portion including preventing means for preventing the removed toner accommodated in the toner recovery housing unit from collecting near said air flow portion.

12. An image forming apparatus according to claim 11, wherein said preventing means includes a side wall formed on a circumference of the air flow portion.

13. An image forming apparatus according to claim 11, wherein said air flow portion includes a filter for preventing the recovered toner accommodated in the toner unit from passing outside of the toner unit.

14. A toner unit according to claim 8, wherein the air flow portion includes a filter for preventing the recovered toner accommodated in the toner recovery housing unit from passing outside the housing unit.

15. An image forming apparatus according to claim 11, wherein the air flow portion of the toner unit comprises a filter for preventing the recovered toner accommodated in the toner recovery housing unit from passing outside of the housing unit.

16. An image forming apparatus according to claim 11, wherein the toner supply unit of the toner unit comprises a toner supply portion engaged with the processing unit to supply the toner to the processing unit when the toner unit is mounted on the processing unit, and wherein the toner recovery housing unit of the toner unit comprises a recovered toner receiving portion engaged with the processing unit to receive recovered toner from the processing unit when the toner unit is mounted on the processing unit.

* * * * *